US011175113B1

(12) United States Patent
Chin

(10) Patent No.: US 11,175,113 B1
(45) Date of Patent: Nov. 16, 2021

(54) THUMB REST AS INTEGRAL PART OF FIREARM

(71) Applicant: Strike Industries, Inc., Santa Ana, CA (US)

(72) Inventor: David Hyung Chin, Santa Ana, CA (US)

(73) Assignee: Strike Industries, Inc., Santa Ana, CA (US)

( * ) Notice: Subject to any disclaimer, the term of this patent is extended or adjusted under 35 U.S.C. 154(b) by 0 days.

(21) Appl. No.: 17/142,547

(22) Filed: Jan. 6, 2021

(51) Int. Cl.
*F41C 23/10* (2006.01)

(52) U.S. Cl.
CPC ..... *F41C 23/10* (2013.01)

(58) Field of Classification Search
CPC ..... F41C 23/10; F41C 23/06
See application file for complete search history.

(56) References Cited

U.S. PATENT DOCUMENTS

| | | | | |
|---|---|---|---|---|
| 1,940,362 A * | 12/1933 | McClarin, Sr. | ..... | F41C 23/10 42/71.02 |
| 2,899,767 A * | 8/1959 | Boudreu | ..... | F41A 19/10 42/75.01 |
| 5,406,731 A * | 4/1995 | Stevens | ..... | F41C 23/10 42/71.02 |
| 2017/0307327 A1* | 10/2017 | Cross | ..... | F41C 23/12 |

* cited by examiner

*Primary Examiner* — J. Woodrow Eldred
(74) *Attorney, Agent, or Firm* — Han IP PLLC; Andy M. Han

(57) ABSTRACT

A device implementable on a firearm includes a grip frame having a frame portion and a grip portion. The frame portion is configured to receive a slide assembly of the firearm thereon. The grip portion is configured to receive a magazine of the firearm therein. The frame portion has a physical feature on at least a left side or a right side thereof functioning as a thumb rest.

18 Claims, 4 Drawing Sheets

THUMB REST AS INTEGRAL PART OF FIREARM

TECHNICAL FIELD

The present disclosure is generally related to firearm accessories and, more particularly, to a thumb rest as an integral part of a firearm.

BACKGROUND

Unless otherwise indicated herein, approaches described in this section are not prior art to the claims listed below and are not admitted as prior art by inclusion in this section.

On certain firearms, such as semi-automatic pistols for example, a thumb rest is an add-on accessory that a user could install on the firearm to improve recoil control. That is, by resting a thumb on the thumb rest, the user would be able to exert a force onto the firearm via the thumb rest to counter recoil of the firearm when a round of ammunition is fired. However, a conventional thumb rest is typically an extra piece of accessory that is attached to the firearm in a way that tends to be complicated and/or unsecured. For example, some conventional thumb rests require extra pins or a bulky picatinny attachment system to be installed on a firearm. In such cases, the thumb rest (and its attachment) tends to be bulky in size and, undesirably, would make it difficult or impossible to insert the firearm into a holster with the thumb rest installed. Moreover, some conventional thumb rests tend to provide no more than one angle for the thumb of the user to rest on, and from an ergonomic point of view this is not preferable.

SUMMARY

The following summary is illustrative only and is not intended to be limiting in any way. That is, the following summary is provided to introduce concepts, highlights, benefits and advantages of the novel and non-obvious techniques described herein. Select implementations are further described below in the detailed description. Thus, the following summary is not intended to identify essential features of the claimed subject matter, nor is it intended for use in determining the scope of the claimed subject matter.

In view of the aforementioned issues, an objective of the present disclosure is to propose innovative designs of a thumb rest as an integral part of a firearm. It is believed that the proposed designs can avoid or otherwise minimize aforementioned issues associated with conventional thumb rests. That is, as the thumb rest of the proposed designs would be an integral part of the firearm, it would be secured, low-profile and not be bulky in size. Moreover, no additional components would be required for installation of the thumb rest as it is already part of the firearm. Furthermore, the thumb rest of the proposed designs would allow a user to apply a force in one of many different angles, thereby addressing the ergonomic issue associated with conventional designs.

In one aspect, a device implementable on a firearm may include a grip frame having a frame portion and a grip portion. The frame portion may be configured to receive a slide assembly of the firearm thereon. The grip portion may be configured to receive a magazine of the firearm therein. The frame portion may have an indentation on at least a left side or a right side thereof functioning as a thumb rest.

In another aspect, an apparatus implementable on a firearm may include a grip frame and a slide assembly. The grip frame may be configured to receive the slide assembly thereon. The grip frame may have an indentation on at least a left side or a right side thereof functioning as a thumb rest.

BRIEF DESCRIPTION OF THE DRAWINGS

The accompanying drawings are included to provide a further understanding of the disclosure and are incorporated in and constitute a part of the present disclosure. The drawings illustrate implementations of the disclosure and, together with the description, explain the principles of the disclosure. It is appreciable that the drawings are not necessarily in scale as some components may be shown to be out of proportion than the size in actual implementation to clearly illustrate the concept of the present disclosure.

DETAILED DESCRIPTION OF PREFERRED IMPLEMENTATIONS

Figure 1:
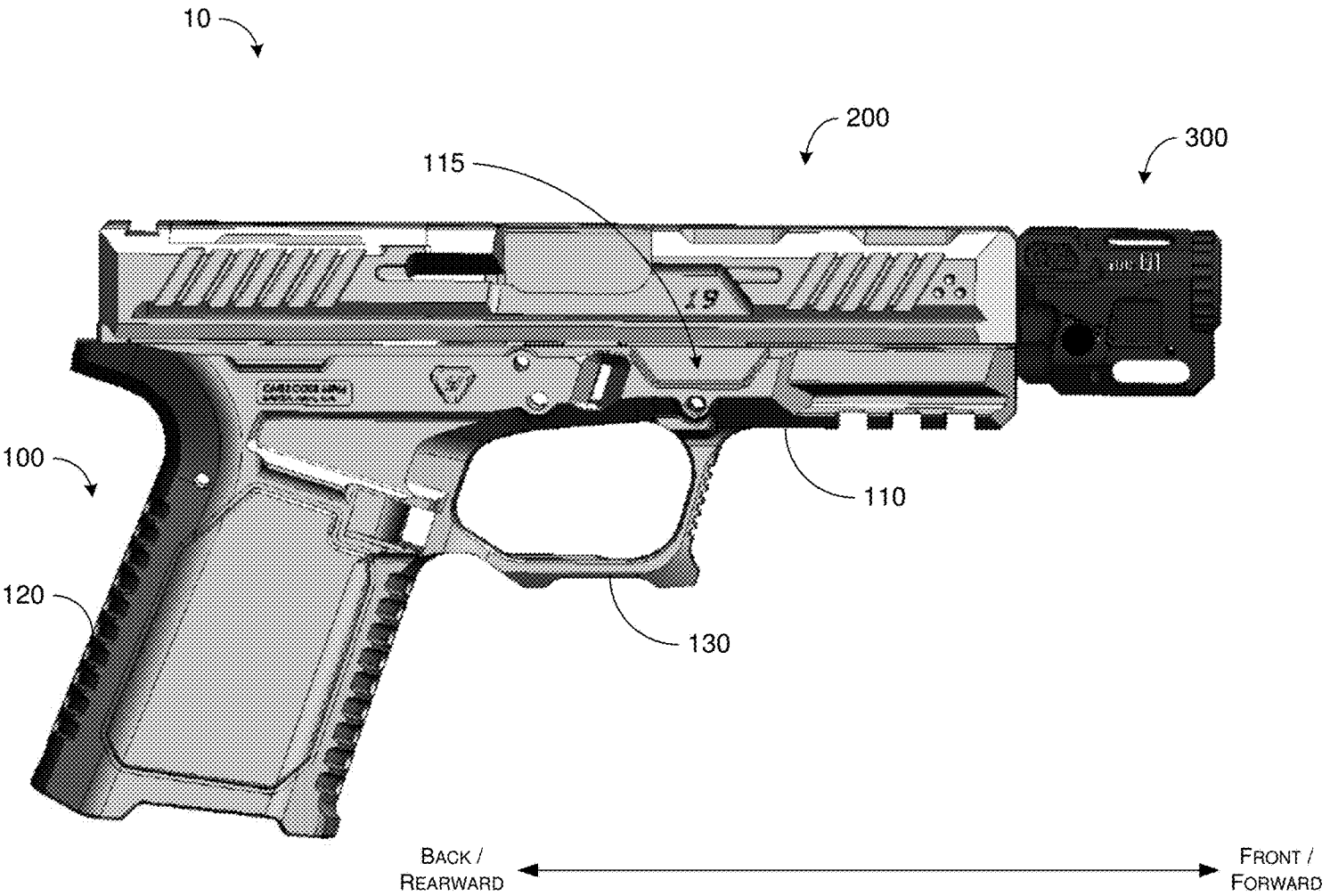
FIG. 1 is a diagram of a side view of an apparatus in accordance with an implementation of the present disclosure.

Detailed embodiments and implementations of the claimed subject matters are disclosed herein. However, it shall be understood that the disclosed embodiments and implementations are merely illustrative of the claimed subject matters which may be embodied in various forms. The present disclosure may, however, be embodied in many different forms and should not be construed as limited to the exemplary embodiments and implementations set forth herein. Rather, these exemplary embodiments and implementations are provided so that description of the present disclosure is thorough and complete and will fully convey the scope of the present disclosure to those skilled in the art. In the description below, details of well-known features and techniques may be omitted to avoid unnecessarily obscuring the presented embodiments and implementations.

The position terms used in the present disclosure, such as "front", "forward", "rear", "back", "top", "bottom", "left", "right", "head", "tail" or the like assume a firearm in the normal firing position, with the firearm being in a position in which the longitudinal axis of the barrel of the firearm runs generally horizontally and the direction of firing points "forward" away from the operator or user of the firearm. The same convention applies for the direction statements used herein.

As used herein, the terms "proximal" and "proximally" may denote "forward" and "forwardly" with respect to the firearm, and the terms "distal" and "distally" may denote "rearward" and "rearwardly" with respect to the firearm. As used herein, the verb "to comprise" in this description, claims, and other conjugations are used in its non-limiting sense to mean those items following the word are included, but items not specifically mentioned are not excluded. As used herein, the word "forward" means moving in the direction that the projectile moves during firing a firearm. As used herein, the word "proximal" means closer to the reference point, in this case, the shooter. As used herein, the word "distal" means farther to the reference point, in this case, the shooter. Reference to an element by the indefinite article "a" or "an" does not exclude the possibility that more than one of the elements are present, unless the context clearly requires that there is one and only one of the elements. The indefinite article "a" or "an" thus usually means "at least one." Additionally, the words "a" and "an" when used in the present document in concert with the words "comprising" or "containing" denote "one or more.

All numeric values are herein assumed to be modified by the term "about," whether or not explicitly indicated. The term "about" generally refers to a range of numbers that one of skill in the art would consider equivalent to the recited value (i.e., having the same function or result). In many instances, the terms "about" may include numbers that are rounded to the nearest significant figure. The recitation of numerical ranges by endpoints includes all numbers within that range (e.g., 1 to 5 includes 1, 1.5, 2, 2.75, 3, 3.80, 4, and 5). All dimensions given herein are by way of examples to better illustrate the present disclosure embodiments and shall not be construed to limit the dimensions of the present disclosure embodiments to the given numeric values.

Overview

Figure 2:
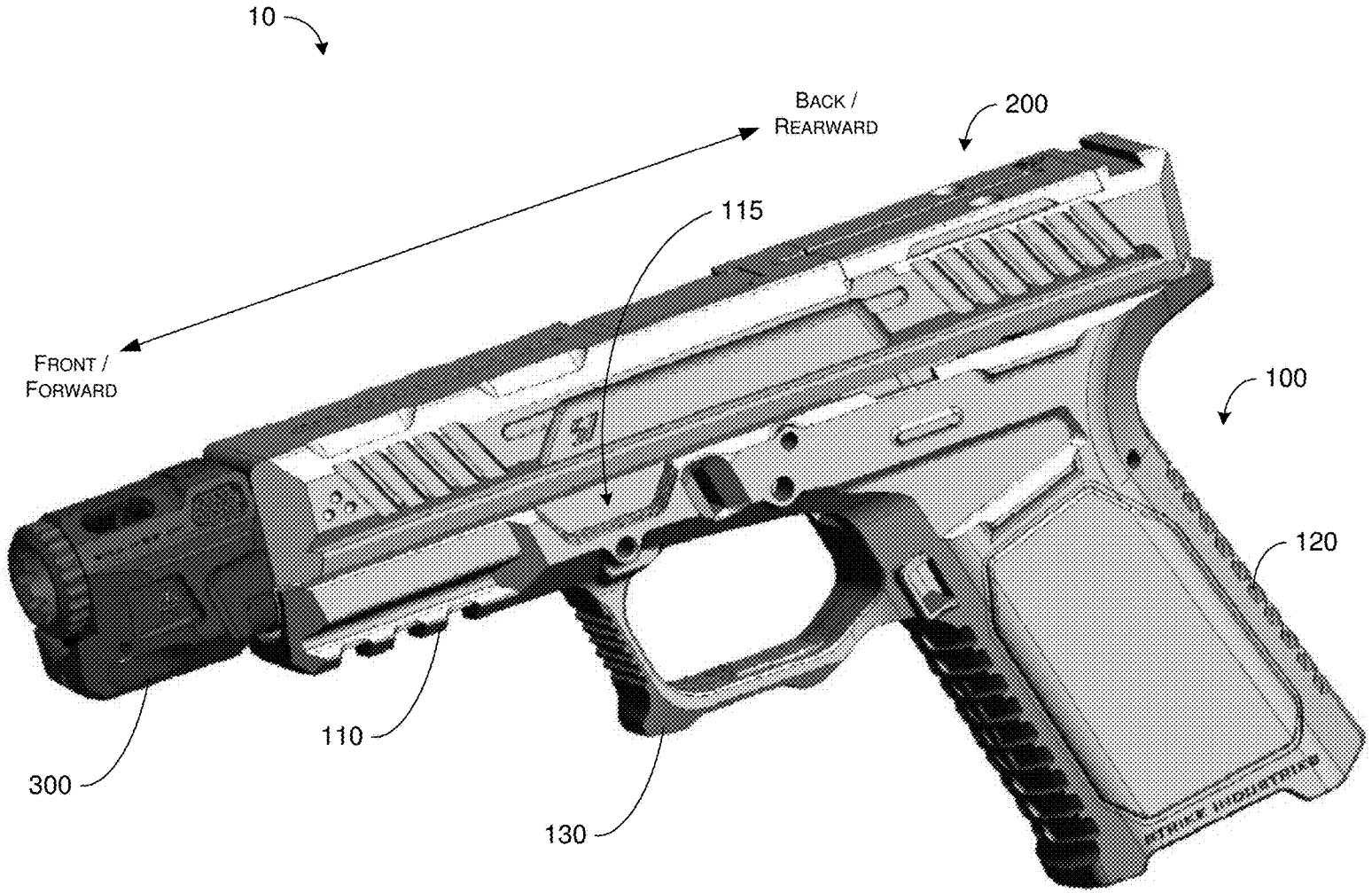
FIG. 2 is a diagram of a perspective view of an apparatus in accordance with an implementation of the present disclosure.
Figure 3:
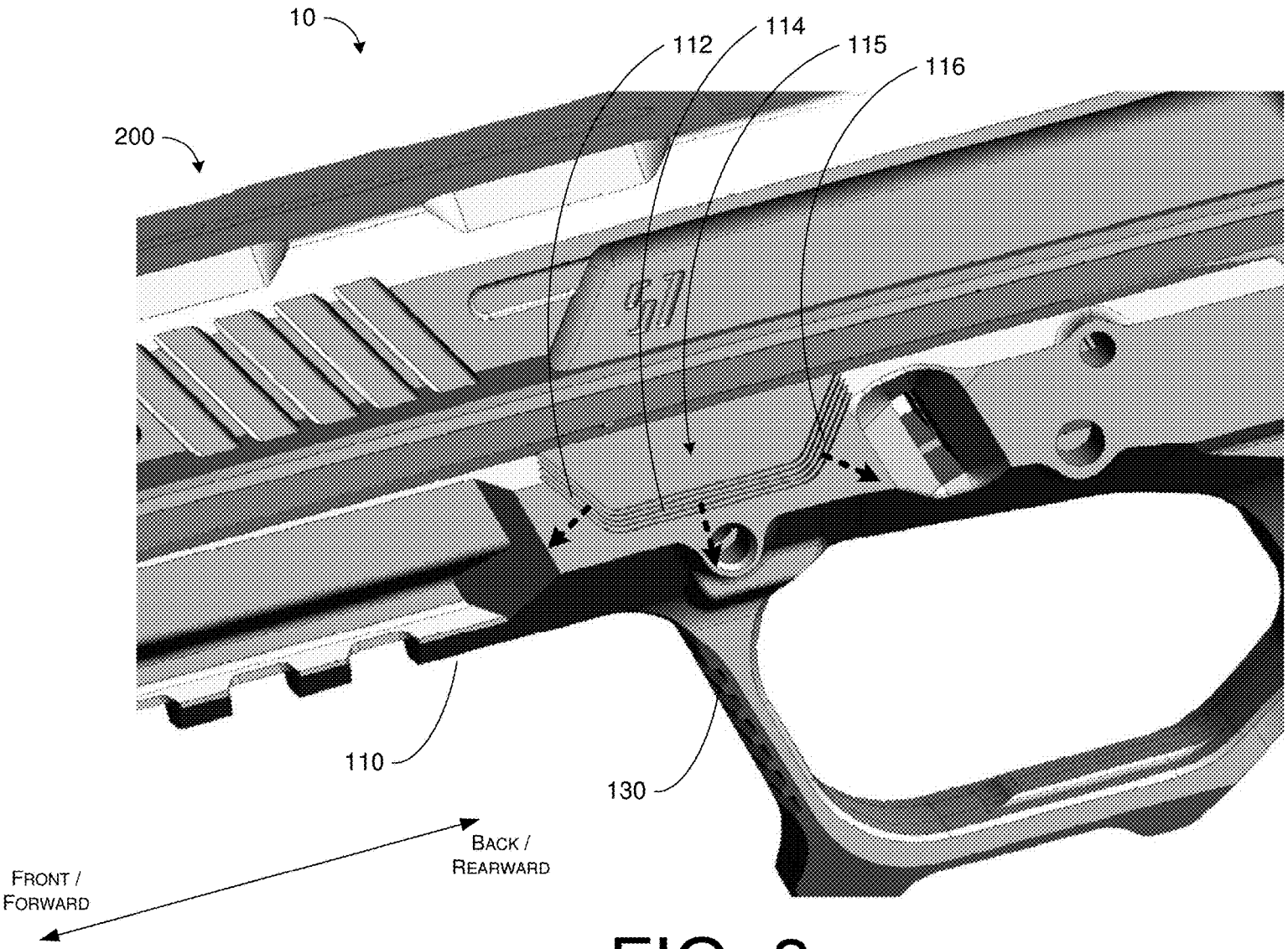
FIG. 3 is a diagram of a close-up view of an apparatus in accordance with an implementation of the present disclosure.
Figure 4:
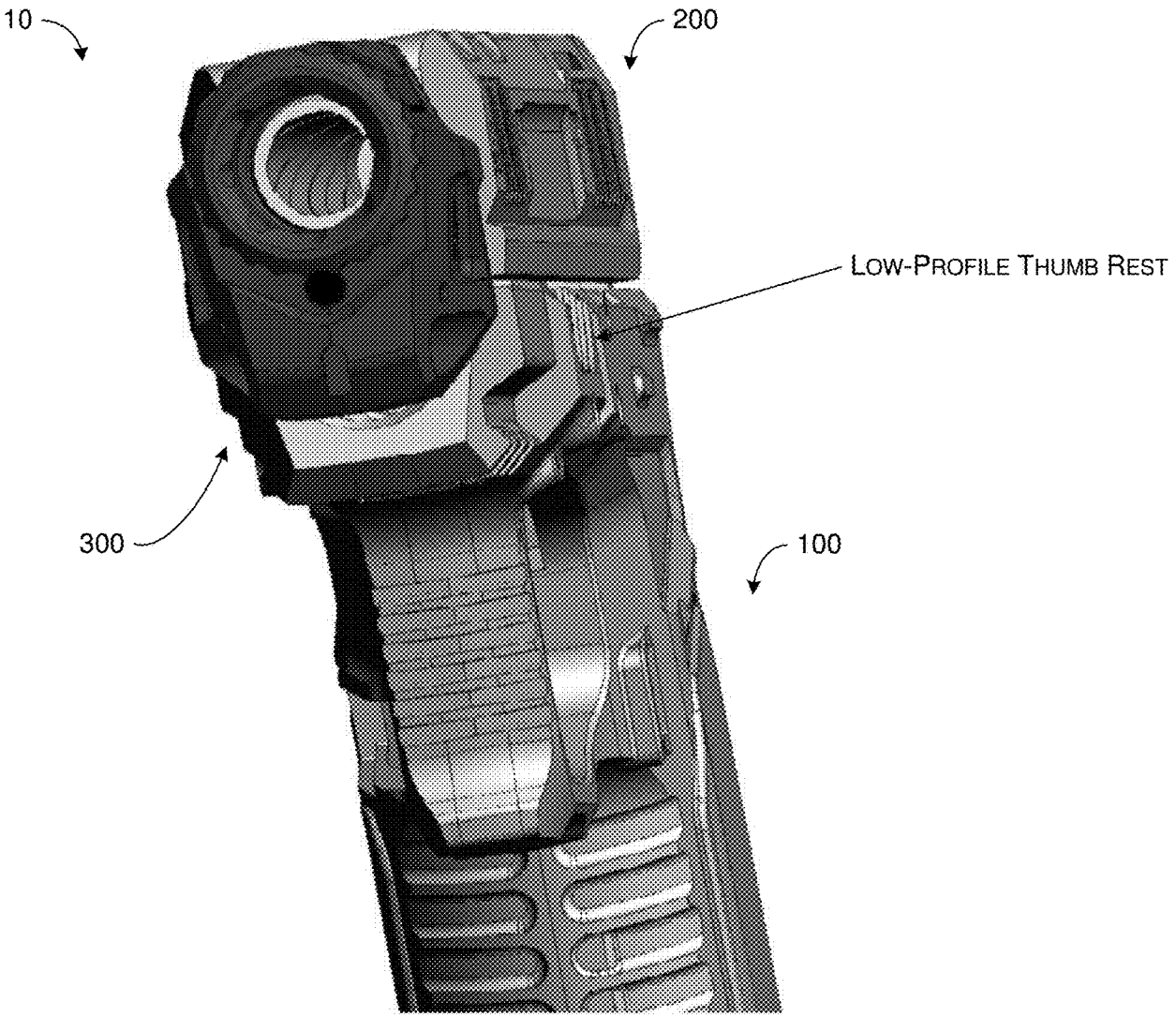
FIG. 4 is a diagram of another perspective view of an apparatus in accordance with an implementation of the present disclosure.

Each of FIG. 1-FIG. 4 illustrates a respective view of an apparatus 10 in accordance with an implementation of the present disclosure. Referring to FIG. 1, apparatus 10 may form part or all of a firearm (e.g., a semi-automatic pistol or full-automatic pistol) and may include a grip frame 100 and a slide assembly 200. Optionally, as shown in FIG. 1, FIG. 2 and FIG. 4, apparatus 10 may further include a compensator 300. Grip frame 100 may include a frame portion 110, a grip portion 120 and a trigger guard 130 disposed between a lower side of frame portion 110 and a front side of grip portion 120. Frame portion 110 may be configured to receive slide assembly 200 thereon for slide assembly 200 to be slidingly mounted on the top side of grip frame 100. Grip portion 120 may be configured to receive a magazine therein. Slide assembly 200 may include a barrel and a firing mechanism (e.g., a striker-firing mechanism or hammer-firing mechanism), which are not shown to avoid obscuring the figures as they are not pertinent to the inventive concepts of the present disclosure. In various proposed designs in accordance with the present disclosure, grip frame 100 may have a physical feature 115 on at least a left side or a right side thereof functioning as a thumb rest.

In one proposed design in accordance with the present disclosure, physical feature 115 may include an indentation which may be generally U shaped with an opening toward a top side of grip frame 100 on which slide assembly 200 is installed.

In one proposed design in accordance with the present disclosure, physical feature 115 may have a plurality of walls each configured to be pressed by a finger of a user of the firearm to exert a force toward a respective direction with respect to grip frame 100, as shown in FIG. 3. For example, physical feature 115 may have at least a front wall 112 configured to be pressed by a finger of a user of the firearm to exert a force toward a front direction with respect to grip frame 100. As another example, physical feature 115 may have at least a bottom wall 114 configured to be pressed by a finger of a user of the firearm to exert a force toward a bottom direction with respect to grip frame 100. As yet another example, physical feature 115 may have a front wall 112, a bottom wall 114 and a back wall 116 each configured to be pressed by a finger of a user of the firearm to exert a force toward a respective direction with respect to grip frame 100.

In one proposed design in accordance with the present disclosure, grip frame 100 may have a left physical feature 115 on the left side thereof and a right physical feature 115 on the right side thereof functioning as a left thumb rest and a right thumb rest, respectively. For instance, FIG. 1 shows a right physical feature 115 as a right thumb rest on the right side grip frame 110, and FIG. 2 and FIG. 3 show a left physical feature 115 as a left thumb rest on the left side of grip frame 110. Advantageously, such a firearm may be considered ambidextrous from the perspective of the user as there would be a thumb rest provided on each of the left side and right side of grip frame 100.

In one proposed design in accordance with the present disclosure, physical feature 115 may be located above a point where trigger guard 130 is connected to frame portion 110, as shown in FIG. 1-FIG. 3.

In view of the above, it is believed that physical feature 115 on grip frame 100 as an integral thumb rest would avoid or otherwise minimize aforementioned issues associated with conventional thumb rests. That is, as the thumb rest of the proposed designs would be an integral part of the firearm, it would be secured, low-profile and not be bulky in size. Additionally, with a built-in thumb rest on each of left and right sides of grip frame 100, the ambidexterity would allow the same firearm to be used by right-handed users as well as left-handed users. Moreover, no additional components would be required for installation of the thumb rest because it is already part of grip frame 100. Furthermore, the thumb rest of the proposed designs would allow a user to apply a force in one or more of many different directions to counter recoil of the firearm.

It is noteworthy that the dimensions of various components of the proposed design may be adjusted to suit actual implementations. For instance, the overall size may be enlarged for implementation on a firearm of a relatively larger caliber (e.g., 0.45 ACP, 10 mm Auto, 0.44 Magnum, 0.454 Casull and 0.460 S&W Magnum). Likewise, the overall size may be reduced for implementation on a firearm of a relatively smaller caliber (e.g., 0.380 ACP, 9 mm, 40 S&W, 0.357 SIG). It is further noteworthy that each component of grip frame 100 may be made of a suitable material (e.g., a suitable metal such as steel, aluminum, alloy or polymer/plastics) with appropriate mechanical properties such as sufficient strengths and/or hardness to withstand vibrations caused by firing of ammunition cartridges.

Example Implementations

In view of the above, the proposed design of a modular forward assist may be implemented in many ways. For illustrative purposes and without limiting the scope of the present disclosure, a few example implementations of the proposed design are described below.

In one aspect, a device (e.g., device 100) implementable on a firearm (e.g., a semi-automatic pistol or a full-automatic pistol) may include a grip frame having a frame portion and a grip portion. The frame portion may be configured to receive a slide assembly of the firearm thereon. The grip portion may be configured to receive a magazine of the firearm therein. The frame portion may have a physical feature on at least a left side or a right side thereof functioning as a thumb rest.

In some implementations, the physical feature may include an indentation which may be generally U shaped with an opening toward a top side of the grip frame on which the slide assembly is installed.

In some implementations, the physical feature may have at least a front wall configured to be pressed by a finger of a user of the firearm to exert a force toward a front direction with respect to the grip frame.

In some implementations, the physical feature may have at least a bottom wall configured to be pressed by a finger of a user of the firearm to exert a force toward a bottom direction with respect to the grip frame.

In some implementations, the physical feature may have a front wall, a bottom wall and a back wall each configured to be pressed by a finger of a user of the firearm to exert a force toward a respective direction with respect to the grip frame.

In some implementations, the physical feature may have a plurality of walls each configured to be pressed by a finger of a user of the firearm to exert a force toward a respective direction with respect to the grip frame.

In some implementations, the frame portion may have a left indentation on the left side thereof and a right indentation on the right side thereof functioning as a left thumb rest and a right thumb rest, respectively.

In some implementations, the grip frame may also include a trigger guard disposed between a lower side of the frame portion and a front side of the grip portion. In such cases, the physical feature may be located above a point where the trigger guard is connected to the frame portion.

In some implementations, the grip frame may be made of polymer.

In some implementations, the grip frame may be made of metal or alloy.

In another aspect, an apparatus (e.g., apparatus 10) implementable on a firearm (e.g., a semi-automatic pistol or a full-automatic pistol) may include a grip frame and a slide assembly. The grip frame may be configured to receive the slide assembly thereon. The grip frame may have a physical feature on at least a left side or a right side thereof functioning as a thumb rest.

In some implementations, the physical feature may include an indentation which may be generally U shaped with an opening toward a top side of the grip frame on which the slide assembly is installed.

In some implementations, the physical feature may have at least a front wall configured to be pressed by a finger of a user of the firearm to exert a force toward a front direction with respect to the grip frame.

In some implementations, the physical feature may have at least a bottom wall configured to be pressed by a finger of a user of the firearm to exert a force toward a bottom direction with respect to the grip frame.

In some implementations, the physical feature may have a front wall, a bottom wall and a back wall each configured to be pressed by a finger of a user of the firearm to exert a force toward a respective direction with respect to the grip frame.

In some implementations, the physical feature may have a plurality of walls each configured to be pressed by a finger of a user of the firearm to exert a force toward a respective direction with respect to the grip frame.

In some implementations, the grip frame may have a left indentation on the left side thereof and a right indentation on the right side thereof functioning as a left thumb rest and a right thumb rest, respectively.

In some implementations, the grip frame may include a frame portion, a grip portion, and a trigger guard disposed between a lower side of the frame portion and a front side of the grip portion. In such cases, the physical feature may be located above a point where the trigger guard is connected to the frame portion.

In some implementations, the grip frame may be made of polymer.

In some implementations, the grip frame may be made of metal or alloy.

Additional Notes

The herein-described subject matter sometimes illustrates different components contained within, or connected with, different other components. It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

Further, with respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

Moreover, it will be understood by those skilled in the art that, in general, terms used herein, and especially in the appended claims, e.g., bodies of the appended claims, are generally intended as "open" terms, e.g., the term "including" should be interpreted as "including but not limited to," the term "having" should be interpreted as "having at least," the term "includes" should be interpreted as "includes but is not limited to," etc. It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to implementations containing only one such recitation, even when the same claim includes the introductory phrases "one or more" or "at least one" and indefinite articles such as "a" or "an," e.g., "a" and/or "an" should be interpreted to mean "at least one" or "one or more;" the same holds true for the use of definite articles used to introduce claim recitations. In addition, even if a specific number of an introduced claim recitation is explicitly recited, those skilled in the art will recognize that such recitation should be interpreted to mean at least the recited number, e.g., the bare recitation of "two recitations," without other modifiers, means at least two recitations, or two or more recitations. Furthermore, in those instances where a convention analogous to "at least one of A, B, and C, etc." is used, in general such a construction is intended in the sense one having skill in the art would understand the convention, e.g., "a system having at least one of A, B, and C" would include but not be limited to systems that have A alone, B alone, C alone, A and B together, A and C together, B and C together, and/or A, B, and C together, etc. In those instances where a convention analogous to "at least one of A, B, or C, etc." is used, in general such a construction is intended in the sense one having skill in the art would understand the convention, e.g., "a system having at least one of A, B, or C" would include but not be limited to systems that have A alone, B alone, C alone, A and B together, A and C together, B and C together, and/or A, B, and C together, etc. It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

From the foregoing, it will be appreciated that various implementations of the present disclosure have been described herein for purposes of illustration, and that various modifications may be made without departing from the scope and spirit of the present disclosure. Accordingly, the various implementations disclosed herein are not intended to be limiting, with the true scope and spirit being indicated by the following claims.

What is claimed is:

1. A device implementable on a firearm, comprising:

a grip frame comprising a frame portion and a grip portion, wherein:

the frame portion is configured to receive a slide assembly of the firearm thereon, the grip portion is configured to receive a magazine of the firearm therein, the frame portion has a physical feature on at least a left side or a right side thereof functioning as a thumb rest, and the physical feature has a front wall, a bottom wall and a back wall each configured to be pressed by a finger of a user of the firearm to exert a force toward a respective direction with respect to the grip frame.

2. The device of claim 1, wherein the physical feature comprises an indentation that is generally U shaped with an opening toward a top side of the grip frame on which the slide assembly is installed.

3. The device of claim 1, wherein the physical feature has at least a front wall configured to be pressed by a finger of a user of the firearm to exert a force toward a front direction with respect to the grip frame.

4. The device of claim 1, wherein the physical feature has at least a bottom wall configured to be pressed by a finger of a user of the firearm to exert a force toward a bottom direction with respect to the grip frame.

5. The device of claim 1, wherein the physical feature has a plurality of walls each configured to be pressed by a finger of a user of the firearm to exert a force toward a respective direction with respect to the grip frame.

6. The device of claim 1, wherein the frame portion has a left indentation on the left side thereof and a right indentation on the right side thereof functioning as a left thumb rest and a right thumb rest, respectively.

7. The device of claim 1, wherein the grip frame further comprises a trigger guard disposed between a lower side of the frame portion and a front side of the grip portion, and wherein the physical feature is above a point where the trigger guard is connected to the frame portion.

8. The device of claim 1, wherein the grip frame is made of polymer.

9. The device of claim 1, wherein the grip frame is made of metal or alloy.

10. An apparatus implementable on a firearm, comprising:

a grip frame; and a slide assembly, wherein:

the grip frame is configured to receive the slide assembly thereon, the grip frame has a physical feature on at least a left side or a right side thereof functioning as a thumb rest, and the physical feature has a front wall, a bottom wall and a back wall each configured to be pressed by a finger of a user of the firearm to exert a force toward a respective direction with respect to the grip frame.

11. The apparatus of claim 10, wherein the physical feature comprises an indentation that is generally U shaped with an opening toward a top side of the grip frame on which the slide assembly is installed.

12. The apparatus of claim 10, wherein the physical feature has at least a front wall configured to be pressed by a finger of a user of the firearm to exert a force toward a front direction with respect to the grip frame.

13. The apparatus of claim 10, wherein the physical feature has at least a bottom wall configured to be pressed by a finger of a user of the firearm to exert a force toward a bottom direction with respect to the grip frame.

14. The apparatus of claim 10, wherein the physical feature has a plurality of walls each configured to be pressed by a finger of a user of the firearm to exert a force toward a respective direction with respect to the grip frame.

15. The apparatus of claim 10, wherein the grip frame has a left indentation on the left side thereof and a right indentation on the right side thereof functioning as a left thumb rest and a right thumb rest, respectively.

16. The apparatus of claim 10, wherein the grip frame comprises a frame portion, a grip portion, and a trigger guard disposed between a lower side of the frame portion and a front side of the grip portion, and wherein the physical feature is above a point where the trigger guard is connected to the frame portion.

17. The apparatus of claim 10, wherein the grip frame is made of polymer.

18. The apparatus of claim 10, wherein the grip frame is made of metal or alloy.

* * * * *